US009145289B2

(12) United States Patent
Reddy

(10) Patent No.: US 9,145,289 B2
(45) Date of Patent: Sep. 29, 2015

(54) MIXING NOZZLE FITMENT AND MIXED LIQUID DISPENSER

(75) Inventor: Balakrishna Reddy, Dublin, OH (US)

(73) Assignee: Nestec S.A., Vevey (CH)

( * ) Notice: Subject to any disclaimer, the term of this patent is extended or adjusted under 35 U.S.C. 154(b) by 878 days.

(21) Appl. No.: 13/263,471

(22) PCT Filed: Apr. 6, 2010

(86) PCT No.: PCT/EP2010/054529

§ 371 (c)(1),
(2), (4) Date: Nov. 30, 2011

(87) PCT Pub. No.: WO2010/115888

PCT Pub. Date: Oct. 14, 2010

(65) Prior Publication Data

US 2012/0107474 A1 May 3, 2012

(51) Int. Cl.
*B67D 1/00* (2006.01)
*B01F 5/04* (2006.01)

(52) U.S. Cl.
CPC ..... *B67D 1/0044* (2013.01); *B67D 1/0021* (2013.01); *B01F 5/0471* (2013.01); *B01F 5/0496* (2013.01)

(58) Field of Classification Search
CPC .. B67D 1/0044; B67D 1/0021; B01F 5/0471; B01F 5/0496
USPC ..... 366/163.2, 163.1, 182.2; 137/803, 801, 137/512.4, 625.42; 251/325.1, 335.2, 335.3
See application file for complete search history.

(56) References Cited

U.S. PATENT DOCUMENTS

| | | | |
|---|---|---|---|
| 1,145,271 | A | 7/1915 | Scanlan |
| 1,901,797 | A | 3/1933 | Black |
| 1,967,799 | A | 7/1934 | Witteman |
| 2,143,817 | A | 1/1939 | Longdin et al. |
| 2,303,799 | A | 11/1942 | Peterson |
| 2,310,265 | A | 2/1943 | Sweeny |
| 2,432,146 | A | 12/1947 | Farris et al. |
| 2,548,938 | A | 4/1951 | Booth et al. |
| 2,785,833 | A | 3/1957 | Bauerlein et al. |
| 3,128,994 | A | 4/1964 | Hungate |
| 3,181,838 | A | 5/1965 | Johansen |

(Continued)

FOREIGN PATENT DOCUMENTS

| | | |
|---|---|---|
| BE | 549933 | 8/1956 |
| DE | 4213895 | 11/1992 |

(Continued)

OTHER PUBLICATIONS

PCT International Search Report for International Application No. PCT/EP2010/054529 with a Date of mailing of May 31, 2010—5 pages.

*Primary Examiner* — Tony G Soohoo
(74) *Attorney, Agent, or Firm* — K&L Gates LLP

(57) ABSTRACT

Mixing nozzle fitments and beverage devices containing the mixing nozzle fitments are provided. In an embodiment, the mixing nozzle fitment includes a first shaft defining an inlet passage, a second shaft defining a curved outlet passage and attached to the first shaft, and a coupling member attached to the second shaft. The coupling member defines a passage that leads into the curved outlet passage of the second shaft. A flexible tube is attached to the coupling member. The mixing nozzle fitment can be used in any suitable beverage dispensing device.

6 Claims, 7 Drawing Sheets

(56) References Cited

U.S. PATENT DOCUMENTS

| | | | | | |
|---|---|---|---|---|---|
| 3,220,703 | A | | 11/1965 | Deuschel | |
| 3,231,140 | A | | 1/1966 | Krup | |
| 3,295,723 | A | | 1/1967 | Welty | |
| 3,322,151 | A | | 5/1967 | Giese et al. | |
| 3,324,877 | A | | 6/1967 | Bochan | |
| 3,333,601 | A | | 8/1967 | Lofgreen | |
| 3,460,717 | A | | 8/1969 | Thomas | |
| 3,756,473 | A | | 9/1973 | Donahue, Jr. | |
| 3,799,952 | A | * | 3/1974 | Chafitz et al. | 552/257 |
| 3,818,938 | A | | 6/1974 | Carson | |
| 3,884,388 | A | | 5/1975 | Holcomb | |
| 3,985,269 | A | | 10/1976 | Bardeau et al. | |
| 4,058,296 | A | | 11/1977 | Wetherby | |
| 4,164,960 | A | * | 8/1979 | Howard | 137/897 |
| 4,186,772 | A | | 2/1980 | Handleman | |
| 4,256,242 | A | * | 3/1981 | Christine | 222/207 |
| 4,552,286 | A | | 11/1985 | Kuckens et al. | |
| 4,750,645 | A | | 6/1988 | Wilson et al. | |
| 4,860,959 | A | | 8/1989 | Handleman | |
| 5,570,822 | A | | 11/1996 | LeMarbe et al. | |
| 5,601,210 | A | | 2/1997 | Kelly et al. | |
| 5,685,639 | A | | 11/1997 | Green | |
| 5,797,519 | A | | 8/1998 | Schroeder et al. | |
| 5,836,484 | A | | 11/1998 | Gerber | |
| 5,882,749 | A | | 3/1999 | Jones et al. | |
| 6,122,980 | A | | 9/2000 | Lewis et al. | |
| 6,402,068 | B1 | | 6/2002 | Handleman | |
| 6,422,608 | B1 | | 7/2002 | Lee et al. | |
| 7,021,206 | B2 | | 4/2006 | Eckenhausen et al. | |
| 7,111,759 | B1 | * | 9/2006 | Gorski et al. | 222/145.6 |
| 7,243,682 | B2 | | 7/2007 | Brandes | |
| 2010/0260892 | A1 | | 10/2010 | Reddy | |

FOREIGN PATENT DOCUMENTS

| | | |
|---|---|---|
| FR | 1220104 | 5/1960 |
| JP | 2003200998 | 7/2003 |
| WO | 01/21292 | 3/2001 |
| WO | 2008098154 | 8/2008 |

* cited by examiner

MIXING NOZZLE FITMENT AND MIXED LIQUID DISPENSER

CROSS REFERENCE TO RELATED APPLICATIONS

The present application is a National Stage of International Application No. PCT/EP2010/054529, filed on Apr. 6, 2010, which claims priority to U.S. patent application Ser. No. 12/420,523, filed on Apr. 8, 2009, the entire contents of which are being incorporated herein by reference.

BACKGROUND

The present disclosure generally relates to beverage dispensing devices. More specifically, the present disclosure relates to mixing nozzle fitments for dispensing beverages.

There are a variety of beverage dispensers currently on the market. Some beverage dispensers operate by dispensing a hot or cold ready-to-drink fluid directly into a container such as a cup. Other beverage dispensers operate by dispensing a powdered or liquid concentrate along with a separate diluent through a beverage dispensing nozzle and into a container or cup to form the drink.

The present invention relates to post-mix dispensers in which a liquid concentrate is stored and is automatically combined at the time of dispensing with a diluents such as water at a predetermined ratio. The combination is usually operated in a mixing chamber in which the concentrate and the diluents emerge. The relative flows of the concentrate and diluent can be controlled to maximize the qualities of the beverage such as mixing and foam production. This mixing chamber can be a mixing tee fitment such as described in WO 01/21292 and U.S. Pat. No. 7,111,759. In these prior arts the mixing tee fitment comprises a horizontal diluent inlet portion joined to vertical beverage outlet portion by an elbow and a vertical concentrate inlet emerging in the horizontal diluent inlet portion.

It has been observed that the above type of fitment could lead to accumulation of concentrate in dead zones. This accumulation can lead to hygienic problems if the beverage concentrates are sensible to bacteria such as milk. This problem is emphasized if the dispenser is intermittently used. In addition the concentrate could also get into the water inlet stream and create problems from a hygienic point of view, especially since the water inlet valve is part of the machine and not easily cleanable.

The present invention aims at solving the hygiene issues relative to this kind of mixing tee fitment.

SUMMARY

In a first aspect the present disclosure relates to mixing nozzle fitments and beverage dispensing devices using the mixing nozzle fitments. In a general embodiment, the mixing nozzle fitment includes a first shaft defining an inlet passage, a second shaft defining a curved outlet passage and attached to the first shaft, and a coupling member attached to the second shaft. A flexible tube is attached to the coupling member. The coupling member defines a passage that leads into the curved outlet passage of the second shaft. The design of the mixing nozzle fitment minimizes concentrate accumulation within the mixing nozzle fitment to improve the hygienicity of the mixing nozzle fitment.

In an embodiment, the second shaft is the shape of a curved horn.

In an embodiment, the second shaft is almost perpendicular to the first shaft near its end portion of the second shaft opposed to the attachment with the first shaft.

In an embodiment, the coupling member is positioned on the second shaft at a location ranging anywhere from a second end of the first shaft to about half way down the second shaft.

In an embodiment, the second shaft includes a flange.

In an embodiment, the first shaft and/or the second shaft includes a textured grip.

In an embodiment, the first shaft and/or the second shaft includes a cylindrical shape.

In an embodiment, the first shaft includes a first end at its inlet and a second end, and the first end having a section that is smaller than the section of the second end.

In an embodiment, the second shaft includes a first end and a second end at its outlet, and the first end having a section that is smaller than the section of the second end.

In an embodiment, a handle is attached to the second shaft.

In a specific embodiment, the present disclosure provides a mixing nozzle fitment including a first cylindrical shaft defining an inlet passage, a second cylindrical shaft defining a curved outlet passage and attached to the first shaft, a coupling member attached to the second shaft, a flexible tube attached to the coupling member and a handle attached to the second shaft. The coupling member defines a passage that leads into the curved outlet passage of the second shaft.

In an embodiment, the coupling member includes a one-way visco-elastic valve. A so-called one-way visco-elastic valve usually comprises a valve body; the valve also comprises an elastomeric cylinder having an internal section smaller than the section of the valve body so that the elastomeric cylinder is tightly fitted over the valve seat. The dispensing with this sort of valve is accomplished by exerting a pressure on the elastic cylinder through the fluid dispensed by the valve. This fluid can circulate either through an internal channel of the valve body connected to one or several fluid delivery ports, and then in the valve body internal channel and delivery ports, or between the valve body and the elastic cylinder. When the fluid pressure exceeds the pressure outside the valve, this pressure urges the elastic cylinder away from the valve body and let fluid flows. When the fluid pressure decreases, the pressure outside the valve body exceeds the fluid pressure and the elastic cylinder is clamped tightly against the valve body, thereby preventing flow back through the valve. Consequently flow is only permitted in one direction.

According to a first mode this valve can comprise an expanded member and a catch.

According to a second mode this valve can comprise a delivery block having an input port for receiving a fluid and an internal channel beginning at the input port and terminating in at least one output port, an elastomeric membrane for enveloping the delivery block such that a portion of the elastomeric membrane covers the output port and the downstream end of the elastomeric membrane forms the valve outlet. Such a valve is for example set forth in U.S. Pat. No. 7,243,682 or U.S. Pat. No. 5,836,484.

In an embodiment, a piercing fitment is included at the end of the flexible tube opposed to the coupling member.

In a second aspect, the present disclosure provides a package a fluid container and a mixing nozzle fitment as defined above, wherein the fluid container is in fluid communication with the flexible tube of the mixing nozzle fitment.

In an embodiment the coupling member comprises a visco-elastic one-way valve attached to the second shaft and emerging into the curved outlet passage of the second shaft.

According to a first mode this valve can comprise an expanded member and a catch.

According to a second mode the visco-elastic one-way valve preferably comprises a delivery block having an input port for receiving a fluid and an internal channel beginning at the input port and terminating in at least one output port, an elastomeric membrane for enveloping the delivery block such that a portion of the elastomeric membrane covers the output port and the downstream end of the elastomeric membrane forms the valve outlet. This kind of visco-elastic one-way valve can be attached to the second shaft by a snap engagement or by an ultrasonic welding.

The container can be a flexible storing pouch.

The container can comprise multiple portions of a food or beverage fluid concentrate. The food or beverage concentrate can be selected in the list of coffee, tea, fruit or vegetable juice, milk, chocolate and combinations thereof.

The food or beverage fluid concentrate can be a microbiological sensitive fluid.

The microbiological sensitive fluid is preferably a milk-based fluid.

The package is usually disposable.

In an third aspect, the present disclosure provides a dispensing device including:

a mixing nozzle fitment as defined above positioned inside the dispensing device so that the first shaft is horizontal and the second shaft is almost vertical near its end portion opposed to the attachment with the first shaft;

a concentrate container attached to the end of the flexible tube of the mixing nozzle fitment opposed to the coupling member, a diluent dispensing nozzle removably attached to the first shaft of the mixing nozzle fitment.

a pump operatively connected to the flexible tube.

The tube can be removably attached to the coupling member depending on the type of coupling member of the mixing nozzle fitment.

The pump can be a peristaltic pump.

In an embodiment, the concentrate container, the tube, the pump, the diluent dispenser and a portion of the mixing nozzle fitment are contained within a housing.

The device can be encompassed in a refrigerated compartment in which at least the concentrate container is placed. Then the mixing nozzle can comprise a flange on the second shaft so as to isolate the refrigerated compartment from the rest of the dispensing device. The flange helps in energy conservation and keeps the refrigerated cabinet in a cooler state.

The concentrate container can be attached to the free end of the flexible tube of the mixing nozzle fitment by a piercing fitment.

In a fourth aspect, the present disclosure provides a method of making a beverage. The method comprises providing a dispensing device as defined above and dispensing portions of concentrate through the mixing nozzle fitment of the package and a diluent through the diluent dispenser nozzle, the concentrate and the diluent being mixed in and dispensed out of the curved outlet passage of the mixing nozzle fitment to form the beverage.

Usually the diluent and the concentrate are delivered simultaneously.

In a preferred alternative, in a first step the diluent and the concentrate are delivered simultaneously, and in a second step, only diluent is delivered. During this second step diluent rinses the coupling member.

An advantage of the present disclosure is to provide an improved mixing nozzle fitment.

Another advantage of the present disclosure is to provide an improved dispensing device.

Still another advantage of the present disclosure is to provide a hygienic mixing nozzle fitment.

Yet another advantage of the present disclosure is to provide a mixing nozzle fitment that eliminates dead zones for product concentrates to collect in.

In addition, another advantage of the present disclosure is to provide an improved method of making a beverage.

Additional features and advantages are described herein, and will be apparent from, the following Detailed Description and the figures.

DETAILED DESCRIPTION

The present disclosure relates to mixing nozzle fitments and beverage dispensing devices using the mixing nozzle fitments. In alternative embodiments, the present disclosure can provide low cost and disposable mixing nozzle fitments for hygienic mixing and delivery of beverage products from concentrates in a dispensing system. The mixing nozzle fitments can be used to mix and dispense a diluent such as water and a beverage concentrate while avoiding dead zones in the mixing nozzle fitments where the beverage concentrate can accumulate. Because the mixing nozzle fitment can be disposed of when a depleted bag of concentrate is thrown away, the need for a dispensing system having an electrically operated mixing bowl or mixing chamber that requires specific cleaning-in-place or cleaning after disassembly can be eliminated.

Figure 1:
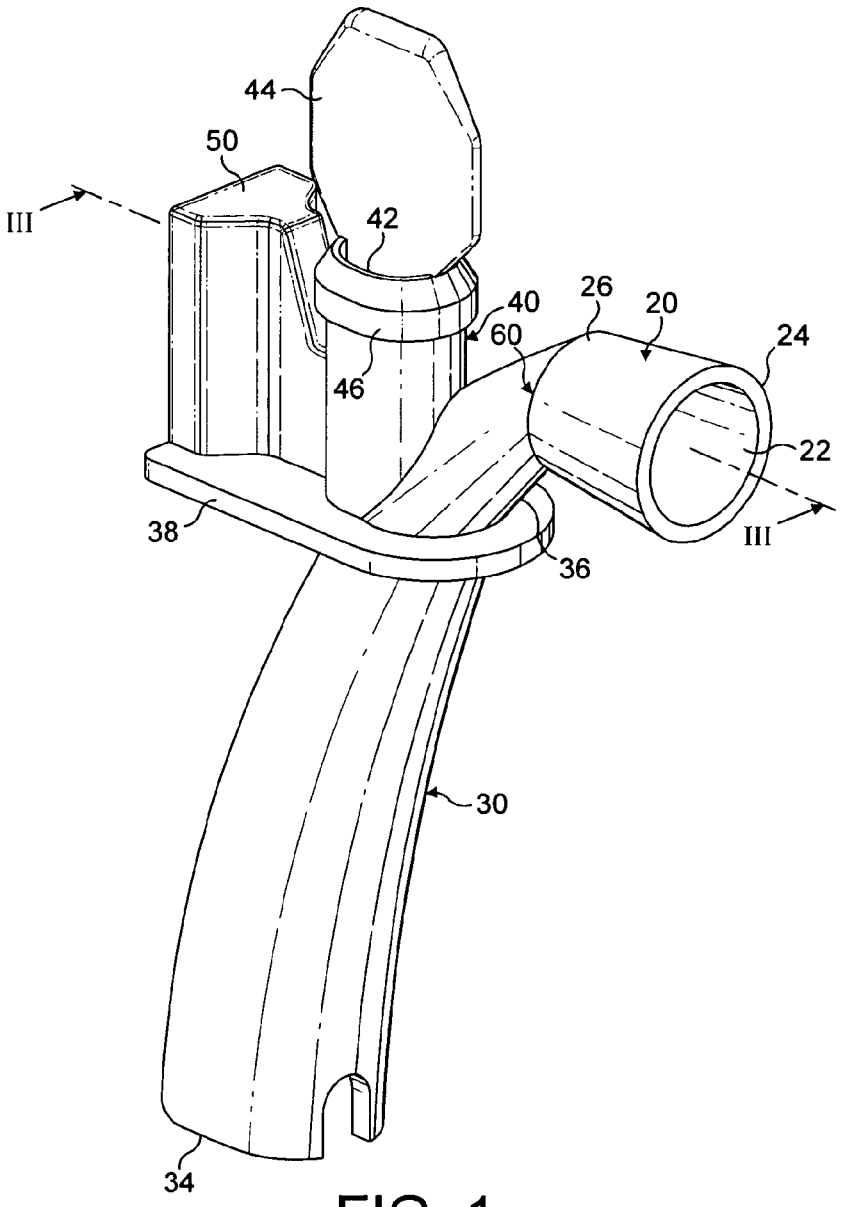
FIG. 1 illustrates a perspective view of a part of the mixing nozzle fitment in an embodiment of the present disclosure.
Figure 2:
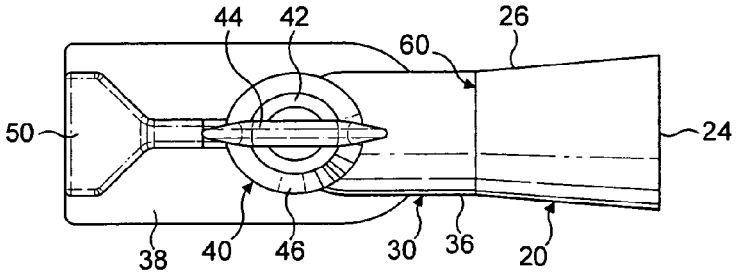
FIG. 2 illustrates a top view of the part of the mixing nozzle fitment shown in FIG. 1.
Figure 3:
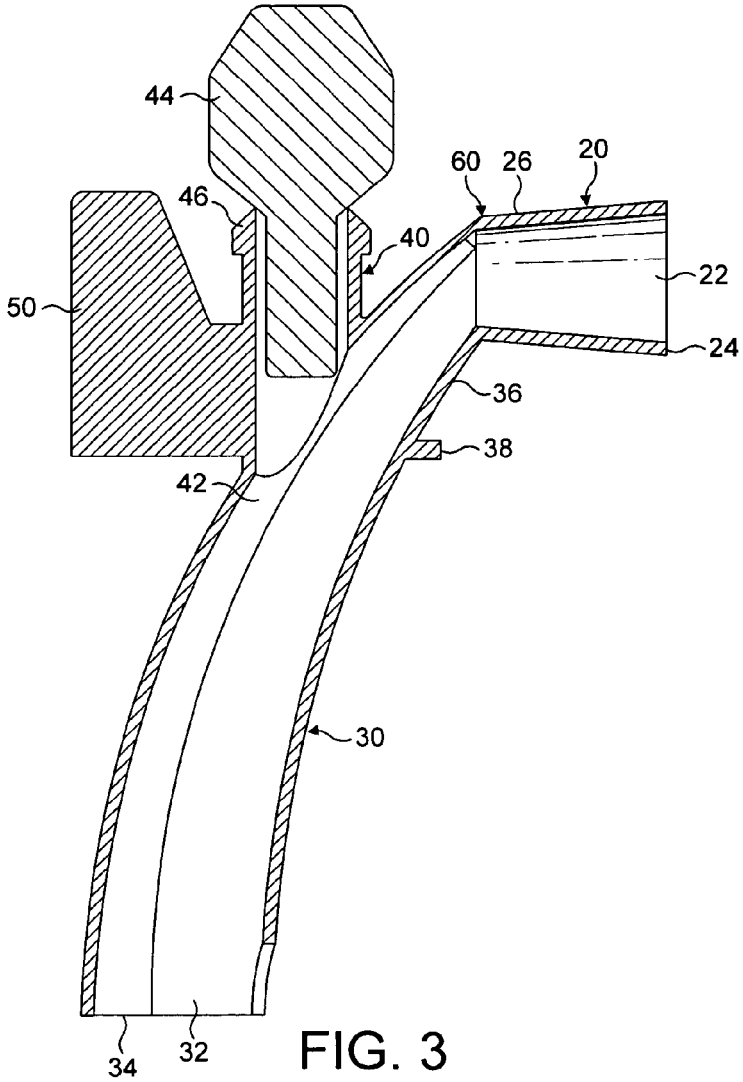
FIG. 3 illustrates a cross section view take along line of the part of the mixing nozzle fitment shown in FIG. 1.

In a general embodiment illustrated in FIGS. 1-3, a mixing nozzle fitment includes a first shaft 20 defining a first passage 22 and a second shaft 30 defining a second curved passage 32 and attached to the first shaft 20. Second shaft 20 further includes a coupling member 40 and a handle 50. First shaft 20 and coupling member 40 act as a fluid inlet and second shaft 30 acts as a fluid outlet.

In the illustrated embodiment, first shaft 20 has a cylindrical shape with a first end 24 that has a larger width or diameter than a second end 26 of first shaft 20. Similarly, second shaft 30 has a cylindrical shape having an oval or elliptical cross-section with a first end 34 that has a larger width or diameter than a second end 36 of second shaft 30. Second end 26 of first shaft 20 is attached to second end 36 of second shaft 30 at joint 60.

The dimensions of mixing nozzle fitment 10 can be any suitable size. For example, a key diameter for mixing nozzle fitment 10 can be based on the interface of a water valve it has to mate with. Other dimensions of mixing nozzle fitment 10 can be based on manufacturing ease.

In another embodiment, second shaft 30 can be designed to incorporate one or more fins (not shown) along its inner walls at an angle to enable better mixing of the concentrate. In yet another embodiment, second shaft 30 may be designed to incorporate a circuitous path (e.g. passage) such that the concentrate and diluent is mixed well by going through a circular path with a downward gradient through second shaft 30.

First shaft 20 and/or second shaft 30 can include various suitable perimeter/cross-sectional shapes such as, for example, polygonal, ellipsoidal, square, oval, triangular, etc. In an alternative embodiment, the opposing ends of first shaft 20 and second shaft 30 can have the same width/diameter.

First shaft 20 is constructed and arranged to be removably attached to any suitable diluent dispensing nozzle or a bore of a diluent line from a dispensing device or machine. For example, first shaft 20 can surround an internal outlet of the diluent dispensing nozzle, which can be firmly fitted inside inlet passage 22 of first shaft 20. The diluent dispensing nozzle should form a tight seal with first shaft 20 to prevent any diluent from leaking at the connection point between first shaft 20 and the dispensing nozzle. As a result, the diluent will not accumulate (e.g. in a dead zone) in any part of inlet passage 22 of first shaft 20.

The embodiment illustrated in FIGS. 1-3 shows that second shaft 30 has a curved shape (e.g. continuously bending line, without angles) from second end 36 to first end 34, for example, in the form of a curved horn. In this regard, second shaft 30 defines a flow passage 32 that is also curved (e.g. continuously bending line, without angles) from second end 36 to first end 34. In addition, in an embodiment, second shaft 30 is designed so that the internal width/diameter of passage 32 steadily increases from second end 36 to first end 34.

Coupling member 40 defines a passage 42 and is positioned downstream or below joint 60 between second end 26 of first shaft 20 and second end 36 of second shaft 30. Passage 42 of coupling member 40 leads into flow passage 32 of second shaft 30. In this manner, coupling member 40 can act as a concentrate outlet for a concentrate to mix with a diluent inside passage 32.

Coupling member 40 can be positioned anywhere along second shaft 30 for example, from second end 26 of first shaft 20 to about half way down second shaft 30. Generally, the higher the inlet position of the concentrate inlet of coupling member 40, the better it is for mixing. Also, in an embodiment, the concentrate inlet should be positioned on the vertical portion of mixing nozzle fitment 10 such that the concentrate does not land onto a horizontal portion of first shaft 20.

Figure 4:
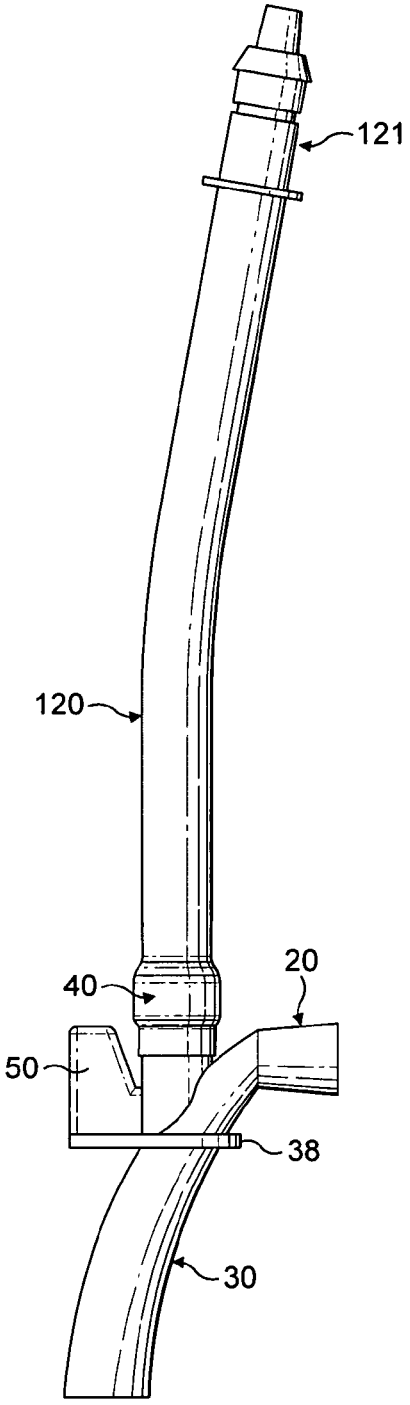
FIG. 4 illustrates a mixing nozzle fitment in an embodiment of the present disclosure.
Figure 5:
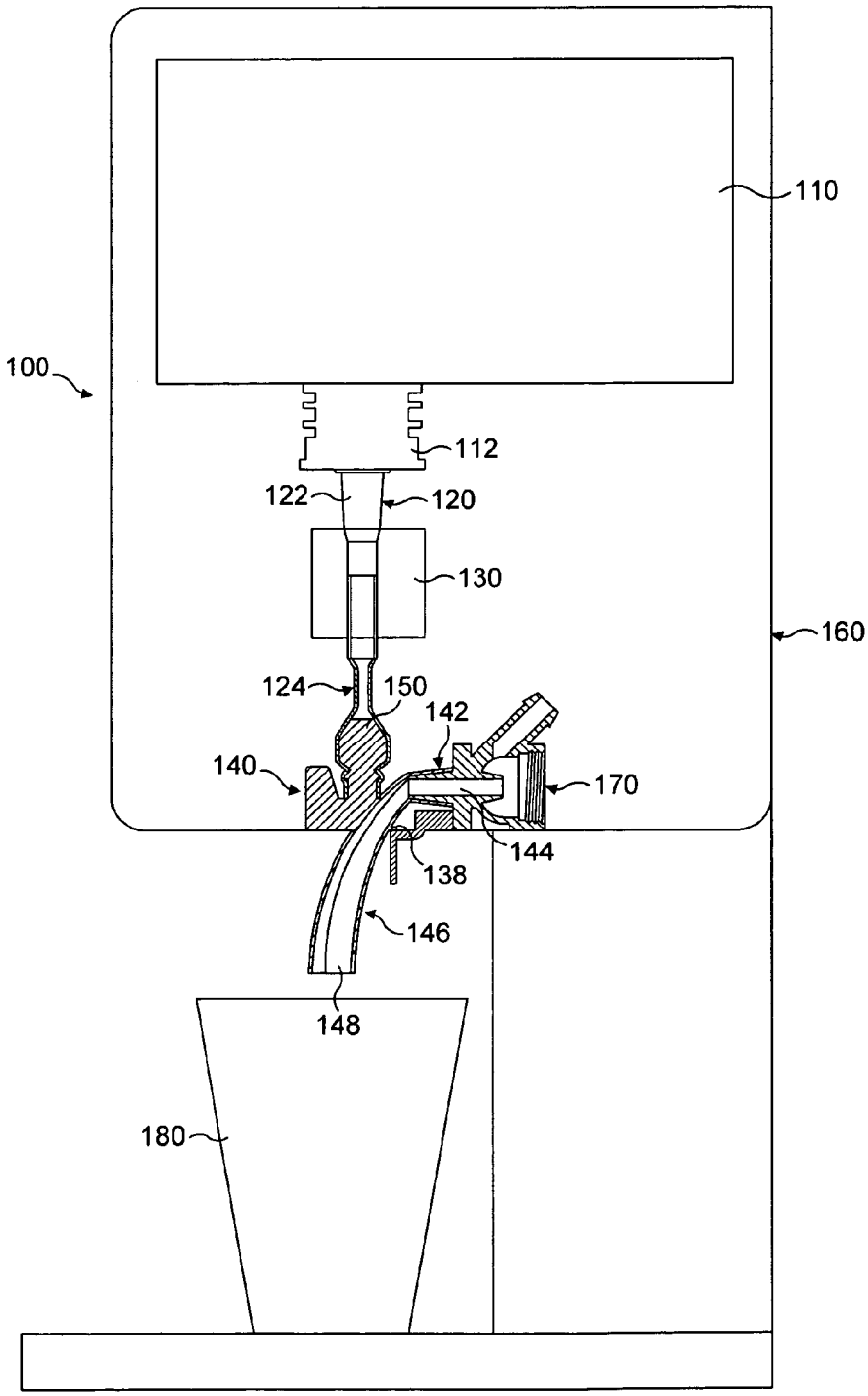
FIG. 5 illustrates a cross section view of a dispensing device having a mixing nozzle fitment in an embodiment of the present disclosure.

In the embodiment illustrated in FIGS. 1-6 and according to a first mode, coupling member 40 includes an expanded member 44 and a catch 46. A tube 120 illustrated on FIG. 4-5 is attached at one end to the coupling member 40 by placing the end of the tube over coupling member 40. For example, the open end of the tube can be stretched and placed over expanded member 44 and catch 46 of coupling member 40. The publication WO 01/21292 illustrates the use of this kind of coupling member. The other end of the tube 120 can be attached to a concentrate container.

Actually coupling member 40 is designed to be connected to a hose for delivering a product such as a concentrate. The hose usually is made of a flexible material so that it can be compressed by means of a pump device, which preferably is a hose pump and most preferably a peristaltic pump that is provided in a drink dispenser. The flexible material of the hose also allows it to resume its original shape after being compressed. Expanded member 44 can have a larger width than the outer diameter of coupling member 40 and thus be designed to ensure that the hose is steadily attached thereto without hose clamps and similar.

Expanded member 44 can serve a check valve function when connected to such a hose. For instance, expanded member 44 closes the tube when the pump device does not apply any pressure on the tube. Expanded member 44 can also facilitate the handling of the concentrate during loading and unloading of the concentrate into the machine.

The check valve can be preferably operated in such way that it opens automatically when the pump device is operating and thereby increases the pressure in the hose and closes automatically when the pump device is disabled and the pressure thereby decreases in the hose. The pump device may be a peristaltic pump or a hose pump of another type that does not compress the hose when the hose is disabled. The hose is threaded over catch 46 and over expanded member 44 of coupling member 40. Accordingly, expanded member 44 expands the flexible hose such that it engages expanded member 44 with a uniform pressure therearound. In this position and without any activation of the pump, the hose end is closed.

When the pump device starts to pump concentrate through the hose, a pressure increase occurs in the hose that is sufficient to expand the outer part of the hose around expanded member 44 such that the concentrate can flow around expanded member 44 and then through passage 42. When the pressure ceases, the outer part of the hose retracts around expanded member 44 and closes the hose, which thereby simply prevents concentrate from unintentionally dripping down into the device.

The configuration of mixing nozzle fitment 10 solves the problem of product accumulation in dead zones within passage 32 of mixing nozzle fitment 10. For example, the curved horned shape of second shaft 30 and passage 32 (outlet end) of mixing nozzle fitment 10 is designed to minimize any beverage concentrate accumulation inside passage 32. In addition, by having concentrate outlet (passage 42) emerge in the diluent conduit (passage 32) downstream of joint 60, when the diluent flow enters in contact with the concentrate, the diluent presents a force sufficient to drag along the concentrate emerging from the concentrate outlet. As a result, no concentrate accumulation is observed in the mixing nozzle fitment 10, which maximizes the hygienicity of mixing nozzle fitment 10.

In alternative embodiments, the mixing nozzle fitment can include any suitable mechanism for attaching to the diluent dispensing nozzle or the diluent line of a dispensing device. For example, the mixing nozzle fitment can include a twist-to-lock feature (e.g. threading on the first shaft) to engage and lock the mixing nozzle fitment to the diluent dispensing nozzle or the diluent line of the dispensing device. Alternatively, the mixing nozzle fitment can include clamps or snap fits that engage with the diluent dispensing nozzle or the diluent line of the dispensing device to lock the mixing nozzle fitment in place.

Second shaft 30 can include a flange 38. Flange 38 can be used as the border when mixing nozzle fitment 10 is used within a housing for a beverage dispenser. For example, the housing containing a beverage device can be opened (e.g. through a front panel door) for receiving the mixing nozzle fitment. When the housing is closed, the only exposed portion of mixing nozzle fitment 10 is a portion below flange 34.

Handle 50 can be any suitable shape that allows a user to securely hold mixing nozzle fitment 10. During use, handle 10 can be grasped by a user who is inserting mixing nozzle fitment 10 into a beverage dispensing device. Handle 50 can also be grasped when removing mixing nozzle fitment 10 from the beverage dispensing device.

In an embodiment, the mixing nozzle fitment can be in the form of a single unitary piece (e.g. molded). Alternatively, the mixing nozzle fitment can be made from a combination of separately made pieces that are attached together via process known in the art. It should be appreciated that the components of the mixing nozzle fitment can be made from any suitable material such as, for example, metal, rigid plastics or polymers or combinations thereof.

FIG. 4 illustrates the complete mixing nozzle fitment with the tube 120 attached to the coupling member 40. The end of the tube 120 opposed to the coupling member 40 comprises a piercing fitment 121 to connect the mixing nozzle fitment to a concentrate container. In practice, this mixing nozzle fitment and the concentrate container can be provided to the operator either separated or fixed together. If the coupling member 40 comprises an expanded member and a catch as illustrated in FIG. 1-6, the mixing nozzle fitment and the concentrate container are preferably separately provided to the operator. Then the operator connects the mixing nozzle fitment of FIG. 4 to the concentrate container only when the assembly of the mixing nozzle fitment and the container must be loaded in the dispenser. The piercing is usually made in a part of the container dedicated to and presenting an interface port adapted to receive the piercing fitment. Once the concentrate container is empty the whole assembly of the mixing nozzle fitment and the concentrate container is disposed.

In an another embodiment illustrated in FIG. 5, the present disclosure provides a dispensing device 100 including a concentrate container 110, a tube 120 having a first end 122 that is attached to an outlet 112 of concentrate container 110 and a pump 130 operatively connected to tube 120. Pump 130 can be, for example, a peristaltic pump that pushes concentrate from concentrate container 110 through tube 120 via a plurality of rotating rollers.

Dispensing device 100 further includes a mixing nozzle fitment 140 including a first shaft 142 defining a first passage 144 and a second shaft 146 defining a second passage 148 and attached to first shaft 142 (e.g. in an embodiment similar to that shown in FIGS. 1-3). Second shaft 146 includes a coupling member 150. Tube 120 can include an end portion 124 that can be removably attached to coupling member 150 of mixing nozzle fitment 140, for example, by being stretched and placed over coupling member 150. The coupling member is preferably a visco-elastic valve either according to the first mode illustrated in FIG. 1-6 or according to the second mode illustrated in FIG. 7-8.

First shaft 142 of mixing nozzle fitment 140 can be removably attached to a diluent line or diluent dispenser nozzle 170. Diluent dispenser nozzle 170 can be fluidly connected to any suitable diluent reservoir and motor or pump (not shown) for driving the diluent from the reservoir through the diluent dispenser and subsequently through mixing nozzle fitment 140.

The mixing nozzle fitment is positioned in the dispensing device so that the first shaft 142 attached to the diluent line is horizontal and the end portion 134 of the second shaft 30 opposed to the attachment with the first shaft 142 is almost vertical.

Concentrate container 110, tube 120, pump 130, diluent dispenser nozzle 170 and mixing nozzle fitment 140 (or a portion thereof) can be contained within any suitable housing 160. As previously discussed, housing 160 containing the beverage device can be opened (e.g. through a front panel door) to receive removable mixing nozzle fitment 140. When housing 160 is closed, for example, the exposed part of mixing nozzle fitment 140 can be a portion below a flange 138 of mixing nozzle fitment 140. Housing 160 can be constructed and arranged so that mixing nozzle fitment 140 dispenses the mixed concentrate and diluent directly into a cup or container 180 as illustrated in FIG. 4. The housing 160 can also be a refrigerated compartment that isolates the concentrate container 110 from the ambient atmosphere to keep it cold. The flange 138 can help in closing the passage at the bottom of the housing for introducing the mixing nozzle fitment and consequently in maintaining the refrigerated compartment isolated from ambient atmosphere and keeping it cold.

Mixing nozzle fitment 140 can seal tightly against diluent dispenser 150 and be easily locked into place. Mixing nozzle fitment 140 permits a supply of hot or cold liquid such as water to dilute and mix with stable, packaged liquid concentrates, and dispense into cup 180. Mixing nozzle fitment 140 provides a way to keep the liquid concentrate from accumulating in any dead zones, which may create sanitary issues (e.g. microbial or quality issues) when the liquid concentrate resides there over time while the beverage dispenser is not in use.

Figure 6:
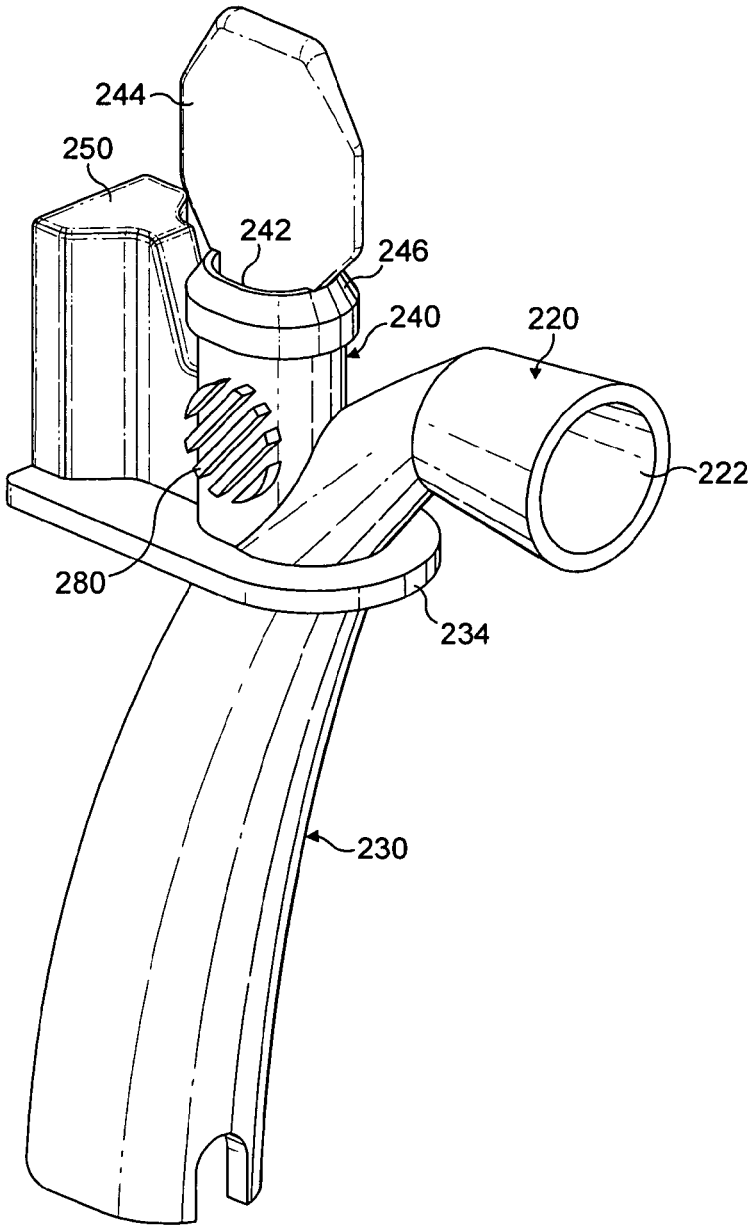
FIG. 6 illustrates a perspective view of a mixing nozzle fitment in another embodiment of the present disclosure.

In an alternative embodiment illustrated in FIG. 6, the present disclosure provides a mixing nozzle fitment including a first elongated cylindrical shaft 220 defining a first passage 222 and a second cylindrical elongated shaft 230 defining a second passage (not shown) and attached to the first elongated cylindrical shaft 220. Second elongated cylindrical shaft 230 includes a coupling member 240. Coupling member 240 can define a passage 242 and can include an expanded member 244 and a catch 246. Second elongated shaft 230 can further include a flange 234.

First elongated shaft 220 and/or second elongate shaft 230 can also include one or more textured grips 280. Textured grips 280 can be mounted on opposing sides of first elongated shaft 220 and/or second elongate shaft 230. During use, textured grips 220 can be grasped by a user who is inserting mixing nozzle fitment 210 into a beverage dispensing device. Textured grips 220 can also be grasped when removing mixing nozzle fitment 210 from the beverage dispensing device.

Figure 7:
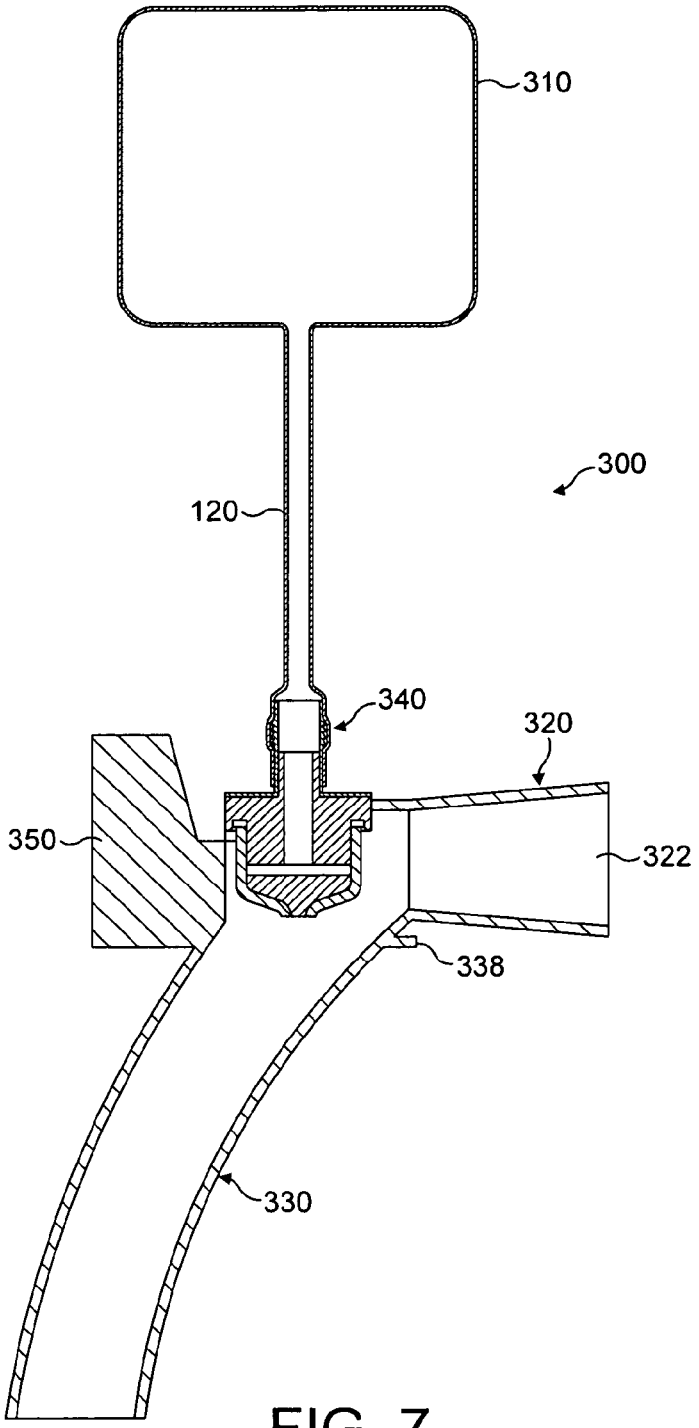
FIG. 7 illustrates a cross section view of a package in an embodiment of the present disclosure.

In an alternative embodiment illustrated in FIG. 7, the present disclosure provides a package 300 comprising a mixing nozzle fitment including a first elongated cylindrical shaft 320 defining a first passage 322 and a second cylindrical elongated shaft 330 defining a second passage and attached to the first elongated cylindrical shaft 320. Second elongated cylindrical shaft 330 includes a coupling member 340 that is a one-way visco-elastic valve according to a second mode of the invention. Except the coupling member, the mixing nozzle fitment can present all the same features as the one described in FIG. 1-6.

The valve used as a coupling member 340 is more precisely described with reference to FIGS. 8*a* and 8*b*. The valve 440 comprises a delivery block 441 having an input port 442 that is connected to the flexible tube 120 for receiving the fluid exiting the tube. The input port 442 opens into an internal channel 443 beginning in the input port and terminating in at least one output port 444. The valve comprises an elastomeric membrane 445 for enveloping the delivery block 441 so that a portion of said flexible elastomeric membrane covers the output ports 444.

Figure 8A:
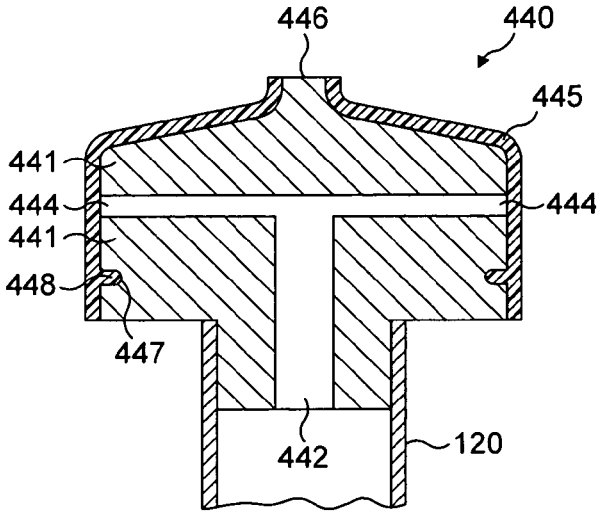
FIG. 8*a*, 8*b* illustrate how the valve used in the embodiment of FIG. 7 works.

FIG. 8*a* illustrates the valve when it is closed, that is when the fluid inside the channel 443 is not pressurized by a pump.

In this configuration the elastomeric membrane 445 hermetically closes the output ports 444.

Figure 8B:
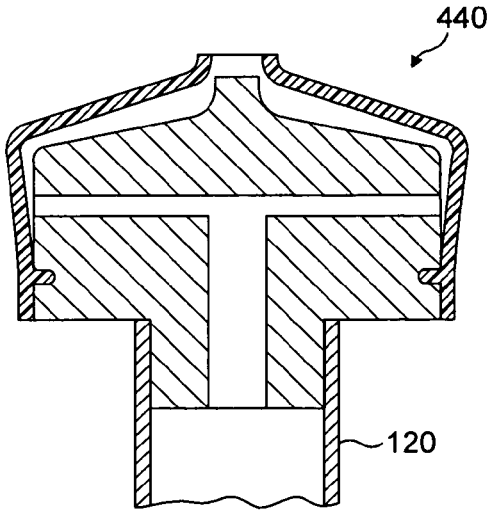

FIG. 8*b* illustrates the valve when it is opened, that is when the fluid inside the channel 443 is pressurized by the pump to move the elastomeric membrane 445 away from the output ports 444. The fluid is then free to pass through the outlets ports 444 and circulates between the elastomeric membrane 445 and the delivery block 441 until. Preferably the elastomeric membrane 445 includes a protrusion 448 that can fit inside a groove 447 in the external part of the delivery block 441 to avoid the elastomeric membrane 445 sliding along the delivery block 441.

In the package 300 of FIG. 7 the one-way visco-elastic valve is coupled to the second shaft 330 so that the valve outlet 446 emerges in the second shaft whereas the input port 442 of the valve is coupled to the flexible tube 120. The flexible tube 120 is also connected to a fluid concentrate container 310. This package 300 can be part of a dispensing device such as illustrated in FIG. 5, the flexible tube being operatively connected with the pumping means 130 and the first shaft of the mixing nozzle fitment being connected to the diluent dispenser nozzle 170.

Preferably the valve is positioned in the second shaft 330 so that the diluent emerging from the first shaft 320 flushes the outlet 446 of the valve to mix with the concentrate and to eliminate any concentrate residues at the end of the dispensing. Due to the fact that the outlet 446 of the valve is hermetically closed when the pump is not active, no water can rise in the coupling during the rinsing while when the concentrate is dispensed the water cannot rise since the concentrate flows down from a higher pressure area to a lower pressure area. Moreover no water can stagnate in the coupling between two beverage or food preparation. This embodiment is particularly adapted for the intermittent delivery of beverage or food. Further there is no collection of diluted product trapped in the mixing zone of the nozzle.

The package preferably further includes a flange 338 and a handle 350 presenting the same functions as for the precedent embodiment of the mixing nozzle fitment.

The one-way visco-elastic valve presents the advantage of providing an aseptic dispensing of the concentrate. Its combination with the configuration of mixing nozzle fitment 10 which solves the problem of product accumulation in dead zones within passage 322 provides a very hygienic delivery of food and beverages particularly from microbiological sensitive products.

Moreover due to the attachment of the one-way visco-elastic valve to the second shaft, said shaft acts as a protecting cover for the valve which cannot be touched by the operators hands during placement in the dispenser.

The package presents also the advantage of enabling a very rapid and easy loading of a new concentrate container in the dispenser: the operator has just to connect the diluent dispensing nozzle to the first shaft of the mixing nozzle fitment and adjust the flexible tube with the pump device. Once the concentrate container is empty the whole assembly of the package can be disposed. The nozzle is also designed to handle both cold and hot water mixing. Hot water could also be used for rinsing to maintain hygienic requirements in cold dispensing applications.

In yet another embodiment, the present disclosure provides a method of making a beverage. The method comprises providing a dispensing device such as described above including:

a mixing nozzle fitment such as described above positioned inside the dispensing device so that the first shaft is horizontal and the second shaft is almost vertical near its end portion opposed to the attachment with the first shaft, a concentrate container attached to the end of the flexible tube of the mixing nozzle fitment opposed to the coupling member, a diluent dispensing nozzle removably attached to the first shaft of the mixing nozzle fitment a pump operatively connected to the flexible tube.

A concentrate is dispensed through the concentrate tube, and a diluent is dispensed through the diluent dispenser nozzle. The concentrate and the diluent are mixed in and dispensed out of the curved outlet passage of the mixing nozzle fitment to form the beverage.

The diluent can be water. The concentrate can be in a suitable form such as a paste, liquid or a combination thereof. The concentrate can have any suitable flavor or combination of flavors as well.

According to a first mode the method can comprise the preliminary steps of providing a mixing nozzle fitment as defined above and attaching the flexible tube 120 to a concentrate container 110 and the first shaft 20 to the diluent dispenser nozzle.

According to a second mode the method can comprise the preliminary steps of providing a package as defined above and attaching the first shaft to the diluent dispenser nozzle.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention claimed is:

1. A package comprising:

a fluid container; and a mixing nozzle fitment comprising a first hollow shaft defining an inlet passage, a second hollow shaft defining a curved outlet passage and being attached to the first hollow shaft at a joint, and a coupling member attached to the second hollow shaft downstream of the joint, the coupling member defining a passage that leads into the curved outlet passage of the second hollow shaft; and a flexible tube attached to the coupling member;

the fluid container is in fluid communication with the flexible tube of the mixing nozzle fitment.

2. The package of claim 1 wherein the coupling member is a visco-elastic one-way valve comprising an expanded member and a catch.

3. The package according to the claim 1 wherein the coupling member is a visco-elastic one-way valve comprising a delivery block having an input port for receiving the fluid and an internal channel beginning at the input port and terminating in at least one output port, an elastomeric membrane for surrounding the delivery block such that a portion of the elastomeric membrane covers the output port and the downstream end of the elastomeric membrane forms the valve outlet.

4. The package according to claim 3, wherein the visco-elastic one-way valve is attached to the second shaft by a snap engagement or by ultrasonic welding.

5. Package according to claim 1, wherein the container comprises multiple portions of a food or beverage fluid concentrate.

6. Package according to claim 5, wherein the food or beverage fluid concentrate is a microbiological sensitive fluid.

* * * * *